US011071419B2

(12) United States Patent
Emam et al.

(10) Patent No.: US 11,071,419 B2
(45) Date of Patent: Jul. 27, 2021

(54) TABBED EASY SLIDING INTERFOLDED DISPENSER NAPKINS

(71) Applicants: Babak Emam, Westlake, OH (US); Peyman Pakdel, Akron, OH (US)

(72) Inventors: Babak Emam, Westlake, OH (US); Peyman Pakdel, Akron, OH (US)

(73) Assignee: NOVEX PRODUCTS INCORPORATED, Lorain, OH (US)

( * ) Notice: Subject to any disclaimer, the term of this patent is extended or adjusted under 35 U.S.C. 154(b) by 239 days.

(21) Appl. No.: 15/658,472

(22) Filed: Jul. 25, 2017

(65) Prior Publication Data

US 2018/0310783 A1 Nov. 1, 2018

Related U.S. Application Data

(60) Provisional application No. 62/491,549, filed on Apr. 28, 2017.

(51) Int. Cl.
*A47K 10/44* (2006.01)
*A47K 10/16* (2006.01)
(Continued)

(52) U.S. Cl.
CPC ..... *A47K 10/44* (2013.01); *A47K 10/16* (2013.01); *D21H 27/00* (2013.01);
(Continued)

(58) Field of Classification Search
CPC ..... A47K 10/42; A47K 10/421; A47K 2010/3266; A47K 2010/428; B65D 83/08; B65D 2583/005
(Continued)

(56) References Cited

U.S. PATENT DOCUMENTS 404,622 A * 6/1889 Hicks ..... A47K 10/421 221/48
1,657,942 A * 1/1928 Spaldo ..... B65D 83/0847 206/216
(Continued)

FOREIGN PATENT DOCUMENTS

EP 0286538 B1 1/1992

*Primary Examiner* — Rakesh Kumar
(74) *Attorney, Agent, or Firm* — Daniel J. Schlue; Schlue IP Law

(57) ABSTRACT

A stacked dispenser-napkin composition having a plurality of stacked and interfolded dispenser napkins; each dispenser napkin being embossed and having a male side of the emboss and a female side of the emboss; each dispenser napkin having a first, second, third, and fourth panel, the four panels being defined by a first fold and a second fold; each dispenser napkin's first and second panels being adjacent to each other and having respective areas that are substantially equal; each dispenser napkin's third and fourth panels being adjacent to each other and having respective areas that are substantially equal; the combined areas of each dispenser napkin's first and second panels being greater than the combined areas of the dispenser napkin's third and fourth panels; each dispenser napkin having a tab portion, the tab portion being the portions of the first and second panel areas that are not covered by the third and fourth panel areas when the first and second panels are folded onto the third and fourth panels via the first fold; the plurality of stacked and interfolded dispenser napkins being arranged within the stack such that the positions of the respective tab portions on adjacent dispenser napkins alternate between two opposing sides of the stack; and the plurality of stacked and interfolded dispenser napkins being arranged within the stack such that the position of a stacked dispenser napkin's male side of its emboss is in contact with an adjacent dispenser napkin's female side of its emboss.

14 Claims, 6 Drawing Sheets

(51) Int. Cl.
*D21H 27/00* (2006.01)
*D21H 27/30* (2006.01)
*D21H 27/02* (2006.01)
*A47K 10/42* (2006.01)

(52) U.S. Cl.
CPC ..... *D21H 27/002* (2013.01); *D21H 27/02* (2013.01); *D21H 27/30* (2013.01); *A47K 10/42* (2013.01); *A47K 2010/428* (2013.01)

(58) Field of Classification Search
USPC ..... 221/63, 48, 33, 50, 503, 46, 52
See application file for complete search history.

(56) References Cited

U.S. PATENT DOCUMENTS 2,085,649 A * 6/1937 Gluck ..... B65D 83/0847 206/449
2,195,622 A * 4/1940 Fourness ..... B65D 83/0894 221/63
2,611,482 A * 9/1952 Nelson ..... B65D 83/0894 221/51
3,209,941 A * 10/1965 Krake ..... A47K 10/421 221/48
3,456,844 A * 7/1969 Planner ..... B65D 83/0847 221/63
3,482,734 A * 12/1969 Mierson ..... B65D 83/0811 221/63
3,612,264 A * 10/1971 Trunick ..... B65D 83/08 206/449
3,684,086 A * 8/1972 Harrison ..... B65D 75/5827 206/449
3,700,138 A * 10/1972 Nelson ..... B65D 25/52 221/51
3,881,632 A * 5/1975 Early ..... B65D 83/0811 221/50
3,896,966 A * 7/1975 Canno ..... B65D 83/0852 221/63
4,070,489 A * 1/1978 Pahnke ..... B65D 5/5253 206/45.2
4,175,673 A * 11/1979 McDonald ..... B65D 83/0805 221/63
4,638,921 A * 1/1987 Sigl ..... A47K 10/421 221/1
4,793,487 A * 12/1988 Bentsen ..... B65D 33/001 206/451
4,859,518 A * 8/1989 Schutz ..... A47K 10/42 428/126
5,305,881 A * 4/1994 Caldwell ..... B65D 83/0088 206/494
5,310,057 A * 5/1994 Caldwell ..... B65D 83/0088 206/494
5,443,161 A * 8/1995 Jonese ..... A61F 13/5519 206/278
5,607,754 A * 3/1997 Giles ..... B32B 3/04 428/124
6,030,331 A * 2/2000 Zander ..... A47K 10/421 428/126
6,045,002 A * 4/2000 Wierschke ..... B65H 45/24 206/494
6,213,345 B1 * 4/2001 Plank ..... B65D 83/0805 206/494
6,296,144 B1 * 10/2001 Tanaka ..... B65D 83/0894 206/494
6,299,016 B1 * 10/2001 Bando ..... A47K 10/421 206/207
6,363,851 B1 * 4/2002 Gerhard ..... B41F 17/02 101/483
6,550,634 B1 * 4/2003 Alegre De Miquel ..... A47K 10/421 221/48
6,585,130 B2 * 7/2003 Turbett ..... A47K 10/424 221/45
6,595,386 B2 * 7/2003 Vogel ..... A47K 10/421 206/494
6,602,575 B2 * 8/2003 Lefevre Du Grosriez ..... B65H 29/00 428/121
6,745,917 B2 * 6/2004 Koyama ..... B65H 45/24 221/48
6,901,718 B2 * 6/2005 Osborne ..... B65B 25/145 493/437
6,964,349 B2 * 11/2005 Sears ..... A47K 10/421 206/494
7,028,860 B2 * 4/2006 Behnke ..... A47K 10/422 221/49
7,121,992 B2 * 10/2006 Neubauer ..... B42D 15/008 493/434
7,204,390 B2 * 4/2007 Widlund ..... B65H 45/24 221/47
7,568,594 B2 * 8/2009 Long ..... A47K 10/421 221/63
7,625,333 B2 * 12/2009 Yardley ..... A47G 11/001 493/405
7,762,426 B2 * 7/2010 Stevens ..... B65D 43/162 221/154
8,342,360 B2 * 1/2013 Long ..... B65D 83/0894 221/48
8,871,047 B2 * 10/2014 Hunkeler ..... B42C 3/00 156/200
9,017,790 B2 * 4/2015 Mrvica ..... A61F 13/15747 428/126
9,108,383 B2 * 8/2015 Carlson ..... B31F 5/005
9,199,823 B2 * 12/2015 Penfield ..... B65H 45/24
9,307,876 B2 * 4/2016 Hochtritt ..... A47K 10/42
9,320,372 B2 * 4/2016 Formon ..... B65H 45/24
2003/0062376 A1 * 4/2003 Sears ..... B65H 45/24 221/48
2003/0168194 A1 * 9/2003 Botelho ..... D21F 11/006 162/289
2004/0016211 A1 * 1/2004 Osborne ..... B65B 25/145 53/429
2005/0058807 A1 3/2005 Hochtritt et al.
2006/0237474 A1 * 10/2006 Long ..... B65D 83/0894 221/33
2007/0215632 A1 * 9/2007 Bendor ..... A47K 10/42 221/63
2009/0190866 A1 * 7/2009 Hughes ..... B65D 75/5844 383/207
2014/0209625 A1 * 7/2014 White ..... A47K 10/421 221/63
2018/0310783 A1 * 11/2018 Emam ..... A47K 10/44

* cited by examiner

TABBED EASY SLIDING INTERFOLDED DISPENSER NAPKINS

CROSS-REFERENCE TO RELATED APPLICATIONS

This non-provisional patent application claims priority to U.S. provisional patent application Ser. No. 62/491,549, titled "Tabbed Easy Sliding Interfolded Dispenser Napkins" and having a filing date of Apr. 28, 2017. The subject matter of the provisional patent application is hereby incorporated by reference in its entirety.

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not Applicable.

STATEMENT REGARDING PRIOR DISCLOSURES BY THE INVENTOR OR A JOINT INVENTOR

Not Applicable.

BACKGROUND OF THE INVENTION

A folded paper dispenser napkin is most efficiently used if it is unfolded, thereby making the napkin's entire surface area available to a user. To promote efficiency, it is therefore important to design a folded paper dispenser napkin that can be easily unfolded. If a folded paper dispenser napkin is difficult to unfold, users typically won't bother to unfold it and subsequently tend to compensate for the loss in useful surface area by simply taking more dispenser napkins than they would otherwise need to accomplish the same task; and that results in inefficiency. Folded dispenser napkins having a tab portion are known to be relatively easier to unfold than paper dispenser napkins that do not have tab portions, and it is for this reason that folded dispenser napkins having tab portions typically foster more efficient end use than folded dispenser napkins that do not have a tab portion.

FIGS. 6-*a* and 6-*b* show embodiments directed to making a two-panel dispenser napkin 10 with a tab portion. FIG. 6-*a* is an embodiment directed to making a two-panel dispenser napkin 10 with a tab portion in the front via front folding, and FIG. 6-*b* is an embodiment directed to making a two-panel dispenser napkin 10 with a tab portion in the back via rear folding. In both FIGS. 6-*a* and 6-*b*, the dispenser-napkin length is equal to L, and the dispenser-napkin width is equal to X+Y. FIG. 7 shows the resulting two-panel napkin 10 resulting from the completed front fold shown in FIG. 6-*a*. In FIG. 7, the tab portion 80 length is equal to L, and the tab-portion 80 width is equal to Y−X.

A well known paper-napkin-dispensing apparatus is spring loaded and is intended to dispense one paper-dispenser napkin at a time from a stack of paper-dispenser napkins that have been stacked using the interfolded system. Stacking paper-dispenser napkins using the interfolded system is well known. The interfolded system is commonly used in facial-tissue stacks, and it is because of the interfolded system that a user can pull one facial tissue at a time from a facial-tissue box. The interfolded system is also used in a variety of paper-towel stacks that are used in paper-towal dispensing devices commonly found commercial restrooms. FIG. 1 shows a side view of two dispenser napkins 10 that are stacked using the interfolded system 20, and FIG. 2 shows a side-perspective view of two dispenser napkins 10 that are stacked using the interfolded system 20.

A known short coming of using the interfolded system to stack dispenser napkins 10 having tab portions 80 is that all of the dispenser-napkin tab portions 80 within the stack are arranged on the same side of the stack as shown in FIG. 8; this arrangement results in the stack curving or arching toward the side of the stack with the tabs 80. The curved stacks of dispenser napkins 10 create shipping-and-handling problems.

Four-panel dispenser napkins are well known. To make a four-panel napkin, a napkin is first folded in one direction and then folded again in another. FIGS. 3-5 show the steps for making a four-panel napkin 10; FIG. 3 shows a non-folded napkin 10, FIG. 4 shows the napkin 10 being folded in half, and FIG. 5 shows the napkin 10 subsequently being folded again in a second direction. It is also well known that four-panel dispenser napkins can be stacked using the interfolded system.

It is well known that most dispenser napkins are embossed with various patterns. Embossing not only enhances the aesthetics of the napkin, it also creates: i) more surface area and ii) volume. Embossing creates some surface roughness, which can vary depending on the strength of the embossing pattern, but unlike facial tissues where silkiness of the surface is important to the consumers, some level of roughness is generally desired for paper-napkin applications.

To emboss a pattern, a paper-napkin sheet is passed through rollers with metal engraving. After exiting the embossing section, the paper napkin is embossed. An embossed napkin has a male side of the emboss and a female side of the emboss. The male side of the emboss has a protruding pattern that results in surface roughness. The female side of the emboss, on the other hand, has cavities and its surface is relatively softer than the male side of the emboss.

A shortcoming in the prior art is that four-panel embossed dispenser napkins are commonly arranged using the interfolded system in such a manner that the male side of the emboss of a napkin within the stack is in contact with an adjacent napkin's male side of the emboss. This male-to-male arrangement results in an amount of friction that commonly causes a dispenser napkin to tear when it is being pulled from a napkin dispenser.

A need remains for an improved dispenser-napkin stacking arrangement.

BRIEF SUMMARY OF THE INVENTION

A stacked dispenser-napkin composition having a plurality of stacked and interfolded dispenser napkins; each dispenser napkin being embossed and having a male side of the emboss and a female side of the emboss; each dispenser napkin having a first, second, third, and fourth panel, the four panels being defined by a first fold and a second fold;

each dispenser napkin's first and second panels being adjacent to each other and having respective areas that are substantially equal; each dispenser napkin's third and fourth panels being adjacent to each other and having respective areas that are substantially equal; the combined areas of each dispenser napkin's first and second panels being greater than the combined areas of the dispenser napkin's third and fourth panels; each dispenser napkin having a tab portion, the tab portion being the portions of the first and second panel areas that are not covered by the third and fourth panel areas when the first and second panels are folded onto the third and fourth panels via the first fold; the plurality of stacked and interfolded dispenser napkins being arranged within the stack such that the positions of the respective tab portions on adjacent dispenser napkins alternate between two opposing sides of the stack; and the plurality of stacked and interfolded dispenser napkins being arranged within the stack such that the position of a stacked dispenser napkin's male side of its emboss is in contact with an adjacent dispenser napkin's female side of its emboss.

A stacked dispenser-napkin composition having a plurality of stacked and interfolded dispenser napkins; each dispenser napkin being embossed and having a male side of the emboss and a female side of the emboss; each dispenser napkin having a first, second, third, and fourth panel, the four panels being defined by a first fold and a second fold; each dispenser napkin's first and second panels being adjacent to each other and having respective areas that are substantially equal; each dispenser napkin's third and fourth panels being adjacent to each other and having respective areas that are substantially equal; the combined areas of each dispenser napkin's first and second panels being greater than the combined areas of the dispenser napkin's third and fourth panels; and each dispenser napkin having a tab portion, the tab portion being the portions of the first and second panel areas that are not covered by the third and fourth panel areas when the first and second panels are folded onto the third and fourth panels via the first fold; the plurality of stacked and interfolded dispenser napkins being arranged within the stack such that the positions of the respective tab portions on adjacent dispenser napkins alternate between two opposing sides of the stack.

A stacked dispenser-napkin composition having a plurality of stacked and interfolded dispenser napkins; each dispenser napkin being embossed and having a male side of the emboss and a female side of the emboss; each dispenser napkin having a first, second, third, and fourth panel, the four panels being defined by a first fold and a second fold; each dispenser napkin's first and second panels being adjacent to each other and having respective areas that are substantially equal; each dispenser napkin's third and fourth panels being adjacent to each other and having respective areas that are substantially equal; the combined areas of each dispenser napkin's first and second panels being greater than the combined areas of the dispenser napkin's third and fourth panels; and the plurality of stacked and interfolded dispenser napkins being arranged within the stack such that the position of a stacked dispenser napkin's male side of its emboss is in contact with an adjacent dispenser napkin's female side of its emboss.

A stacked dispenser-napkin composition having a plurality of stacked and interfolded dispenser napkins; each dispenser napkin being embossed and having a male side of the emboss and a female side of the emboss; each dispenser napkin having a first, second, third, and fourth panel, the four panels being defined by a first fold and a second fold; each of the four panels having a different area relative to the other three panels; the combined areas of each dispenser napkin's first and second panels being greater than the combined areas of the dispenser napkin's third and fourth panels; each dispenser napkin having a tab portion, the tab portion being the portions of the first and second panel areas that are not covered by the third and fourth panel areas when the first and second panels are folded onto the third and fourth panels via the first fold; the plurality of stacked and interfolded dispenser napkins being arranged within the stack such that the positions of the respective tab portions on adjacent dispenser napkins alternate between two opposing sides of the stack; and the plurality of stacked and interfolded dispenser napkins being arranged within the stack such that the position of a stacked dispenser napkin's male side of its emboss is in contact with an adjacent dispenser napkin's female side of its emboss.

A stacked dispenser-napkin composition having a plurality of stacked and interfolded dispenser napkins; each dispenser napkin being embossed and having a male side of the emboss and a female side of the emboss; each dispenser napkin having a first, second, third, and fourth panel, the four panels being defined by a first fold and a second fold; each dispenser napkin's first and second panels being adjacent to each other and having respective areas that are substantially equal; each dispenser napkin's third and fourth panels being adjacent to each other and having respective areas that are substantially equal; the combined areas of each dispenser napkin's first and second panels being greater than the combined areas of the dispenser napkin's third and fourth panels; each dispenser napkin having a tab portion, the tab portion being the portions of the first and second panel areas that are not covered by the third and fourth panel areas when the first and second panels are folded onto the third and fourth panels via the first fold; the plurality of stacked and interfolded dispenser napkins being arranged within the stack such that the positions of the respective tab portions on adjacent dispenser napkins alternate between two opposing sides of the stack; and the plurality of stacked and interfolded dispenser napkins being arranged within the stack such that the position of a stacked dispenser napkin's female side of its emboss is in contact with an adjacent dispenser napkin's female side of its emboss.

A commercial advantage of stacked-dispenser napkin embodiments is that because the tab portions 80 of adjacent dispenser napkins 10 alternate from one side to the other, as shown in FIGS. 9, 10, and 13; the stacked embodiments do not curve to one side or the other as in the prior art. As a result, packages of the stacked dispenser-napkin embodiments can be loaded and shipped on pallets much easier compared to known packages of stacked dispenser napkins that curve or arch as described above.

An additional advantage of the embodiments is that because the male side of the emboss of a first napkin is in contact with the female side of the emboss of adjacent dispenser napkins within a stack, or vice versa, dispenser napkins are less likely to rip when pulled from a dispensing apparatus; this is because of the reduced friction between the embodiment's male-to-female-side-of-the-emboss arrangement of adjacent dispenser napkins compared to known male-to-male-side-of-the-emboss arrangement of adjacent dispenser napkins. The embodiment's male-to-female-side-of-the-emboss arrangement within the stack results in fewer dispenser napkins being torn or bunched together during dispensing compared to the number of dispenser napkins that are torn or bunched together during dispensing from known dispensing-napkin stacking arrangements.

Another advantage provided by dispenser-napkin stack embodiments is that the efficient dispensing of napkins is achieved when one or more of the stack embodiments is used in a paper-napkin-dispensing apparatus that is engineered to provide a user with one paper napkin per pull instead of many paper dispenser napkins per pull. Furthermore, using one or more of the stack embodiments with a paper-napkin-dispensing apparatus results in dispensing a paper napkin with each pull, wherein the dispensed napkin is not damaged or ripped because of the friction resulting from the pulling action.

BRIEF DESCRIPTION OF THE SEVERAL VIEWS OF THE DRAWING(S)

Figure 6A:
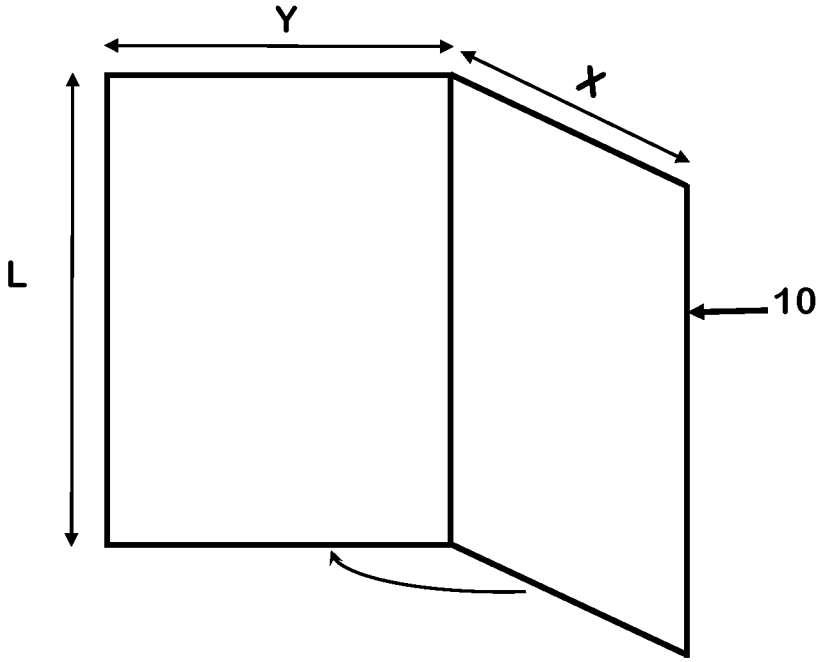
Prior Art Fig. 6a
Figure 6B:
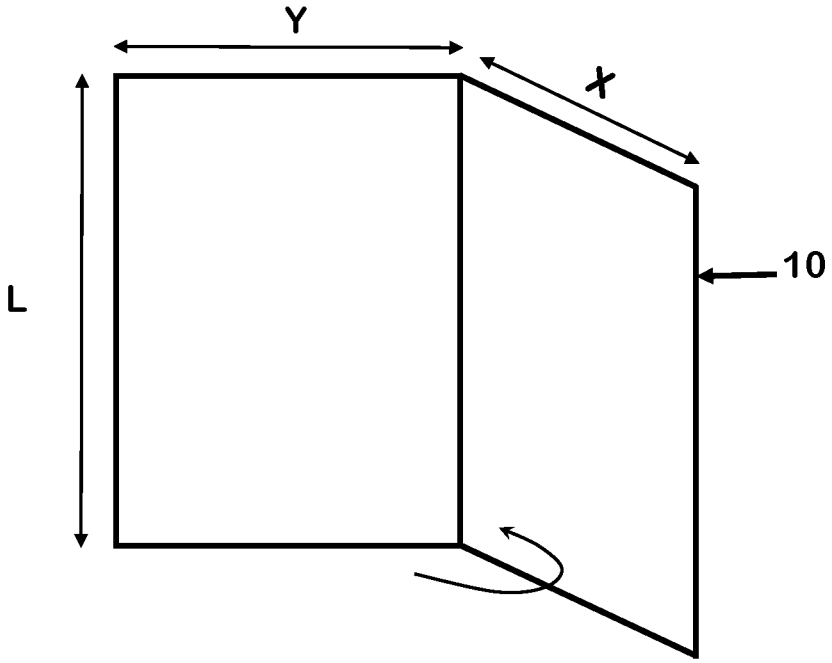
Prior Art Fig. 6b

FIG. 6-*a* shows a perspective view of a dispenser napkin 10 that is being front folded so that the tab portion is in the front of the napkin.

FIG. 6-*b* shows a perspective view of a dispenser napkin 10 that is being rear folded so that the tab portion is in the back of the napkin 10.

Figure 7:
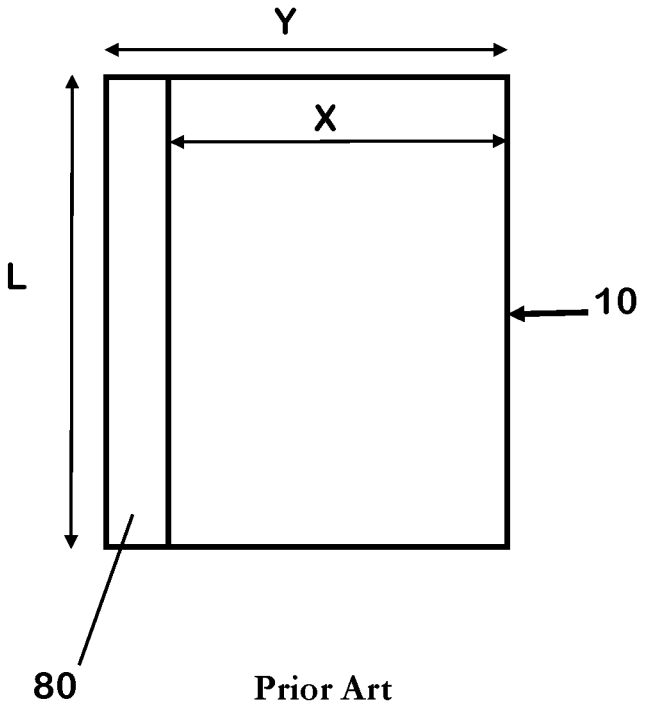
Prior Art Fig. 7

FIG. 7 is shows a top view of the dimensions of a folded napkin 10 having a tab portion 80 in the front.

Figure 8:
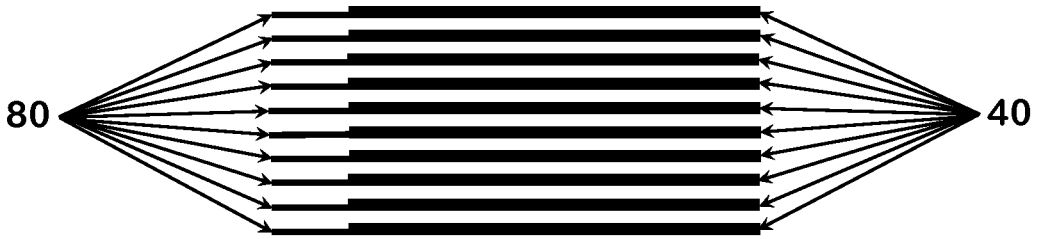
Prior Art Fig. 8

FIG. 8 shows a side view of a prior-art arrangement of stacked dispenser napkins 10 having all of the dispenser-napkin tab portions 80 on the same side of the stack.

Figure 9:
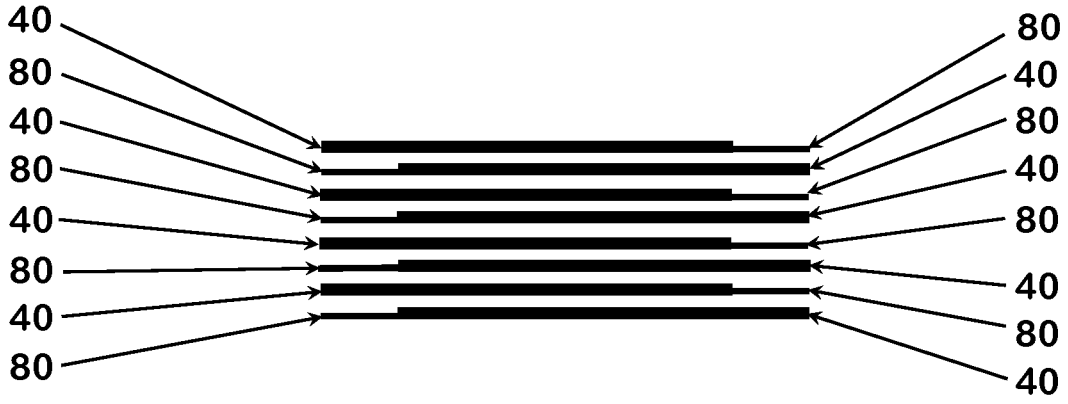

FIG. 9 shows a side view of an embodiment.

Figure 10:
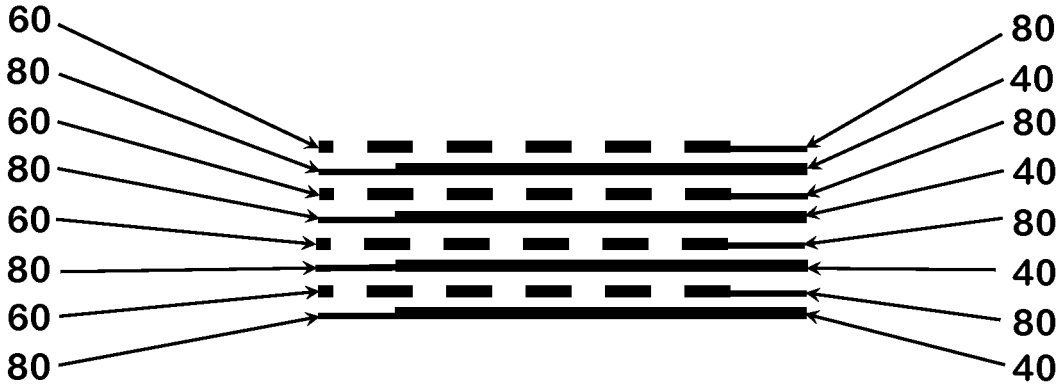

FIG. 10 shows a side view of an embodiment.

Figure 11:
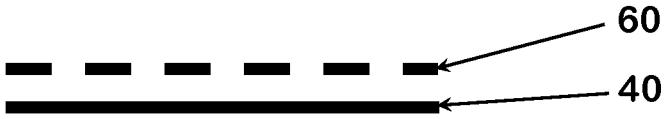

FIG. 11 shows an exploded view of an embodiment.

Figure 12:
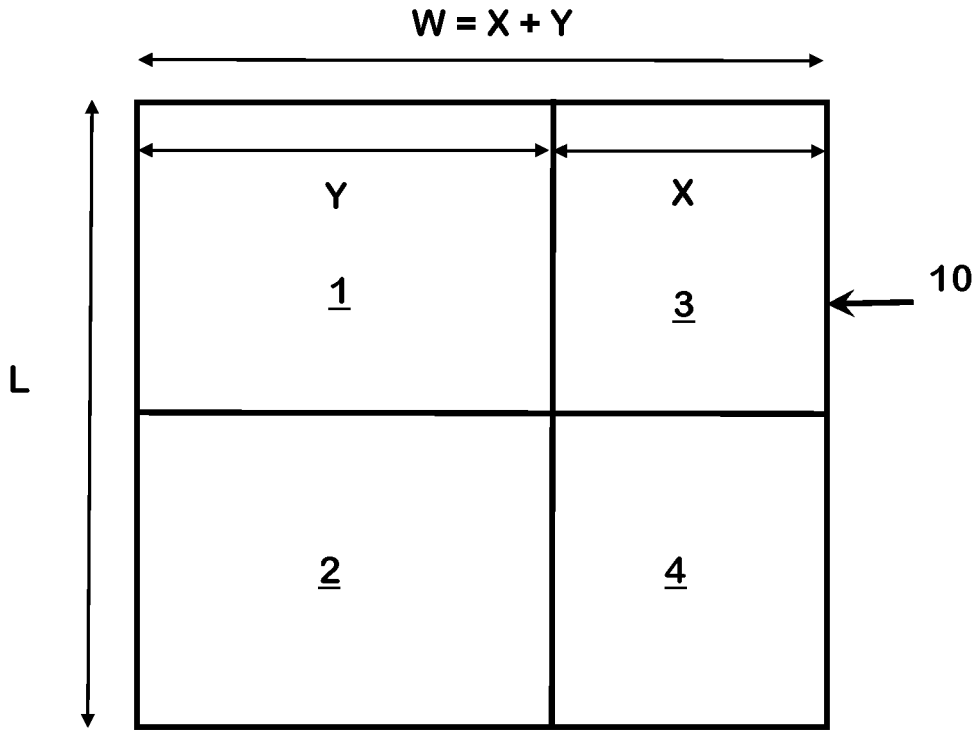
Prior Art Fig. 12

FIG. 12 shows an unfolded four-panel dispenser napkin 10.

Figure 13:
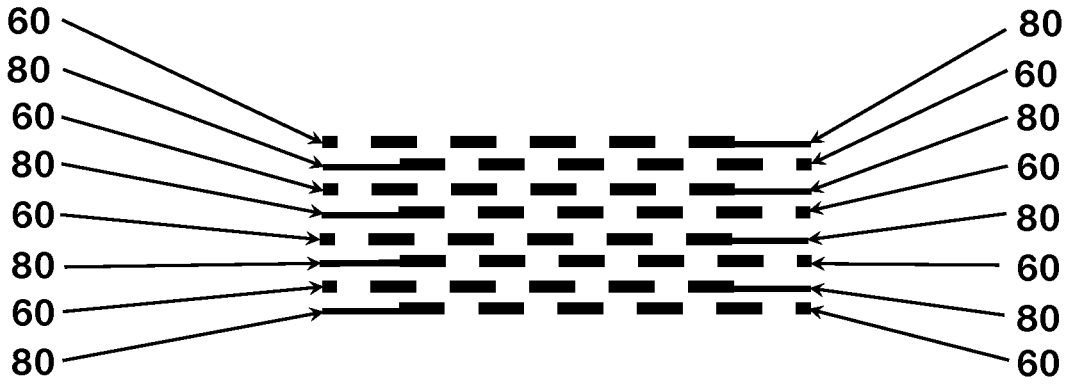

FIG. 13 shows a side view of an embodiment.

DETAILED DESCRIPTION OF THE INVENTION

Figure 1:
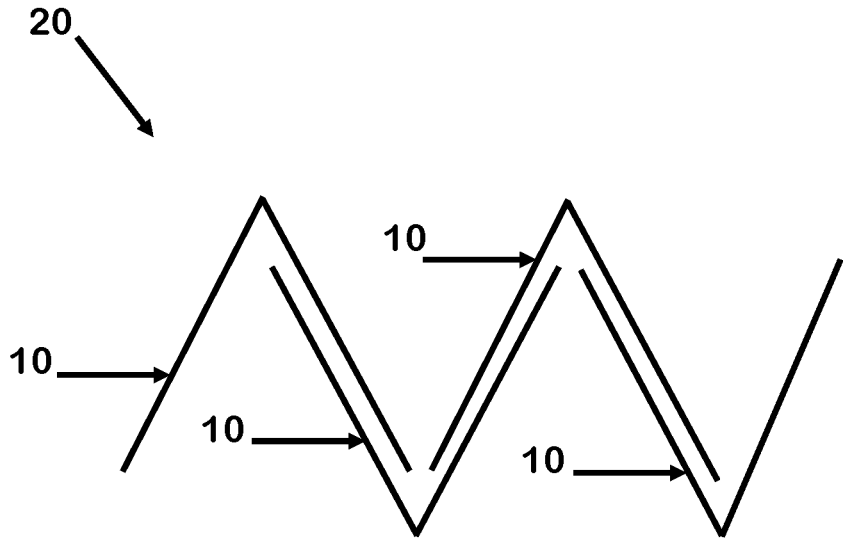
Prior Art Fig. 1
FIG. 1 shows a side view of two dispenser napkins 10 stacked using the interfolded system 20.
Figure 2:
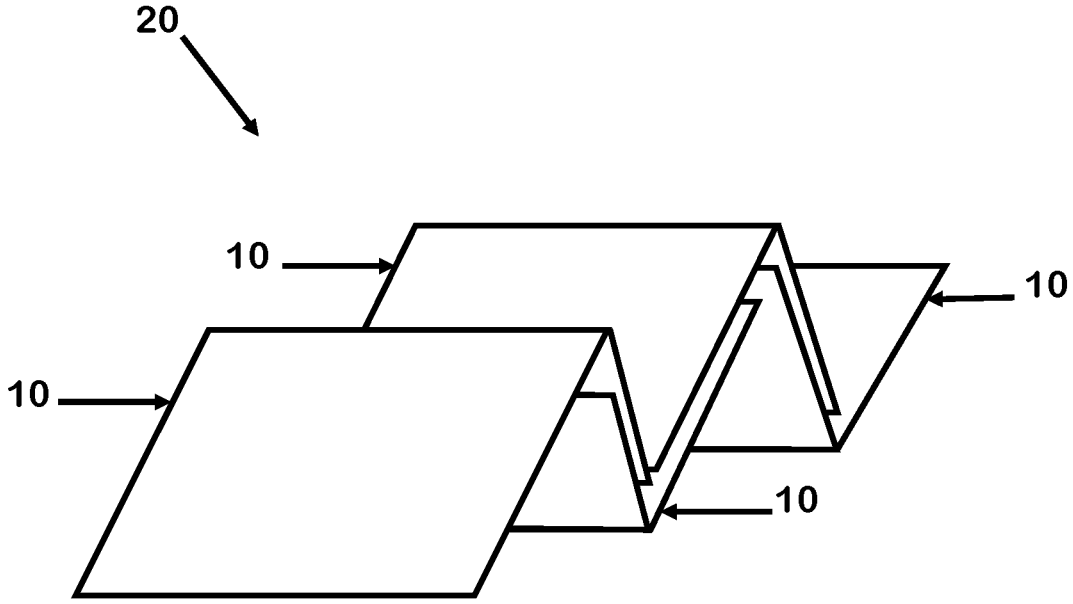
Prior Art Fig. 2
FIG. 2 shows a side-perspective view of two dispenser napkins 10 stacked using the interfolded system 20.
Figure 3:
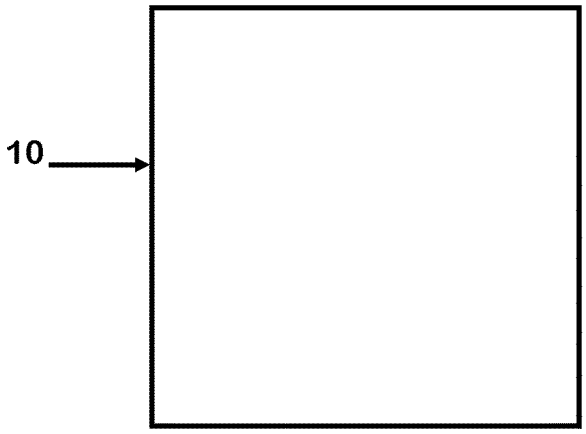
Prior Art Fig. 3
FIG. 3 shows a non-folded napkin 10.
Figure 4:
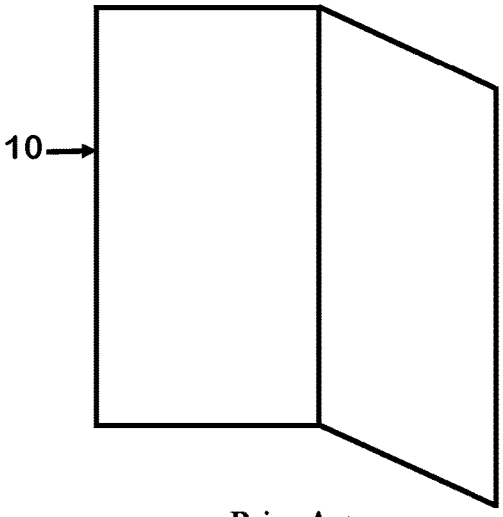
Prior Art Fig. 4
FIG. 4 shows a perspective view of a napkin 10 being folded in a first direction.
Figure 5:
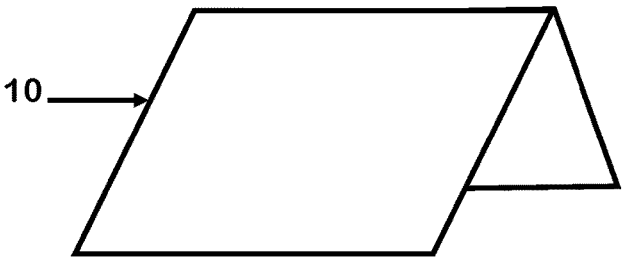
Prior Art Fig. 5
FIG. 5 shows a perspective view of a napkin 10 that was folded in a first direction being folded again in a second direction.

Generally shown are embodiments directed to a stacked dispenser-napkin composition, wherein the dispenser napkins 10 are stacked according to the interfolded system 20 shown in FIGS. 1 and 2, and wherein the dispenser napkins 10 are both i) embossed, and ii) have tab portions 80. More specifically, embodiments are directed to stacked-napkin compositions that: i) have tab-portion 80 positions on adjacent dispenser napkins 10 that alternate between two opposing sides of the stack as shown in FIGS. 9, 10, and 13; and ii) are arranged such that the male side of the emboss 40 of a dispenser napkin 10 within the stack is in contact with the female side of the emboss 60 of adjacent dispenser napkins 10 as shown in FIGS. 10 and 11. In embodiments, an "adjacent dispenser napkin" can also be understood by one of ordinary skill in the art as "the next napkin to be dispensed from the interfolded dispenser-napkin stack."

In FIGS. 8-11 and 13, a relatively thicker solid line figuratively represents a stacked dispenser napkin's male side of the emboss 40 that is in contact with an adjacent dispenser napkin 10; a relatively thicker dashed line figuratively represents a stacked dispenser napkin's female side of the emboss 60 that is in contact with an adjacent dispenser napkin 10; and a relatively thin solid line at the side of a figure represents a tab portion 80 of a stacked dispenser napkin 10.

Alternate embodiments are directed to stacked dispenser-napkin compositions that: i) have tab-portion 80 positions on adjacent dispenser napkins 10 that alternate between two opposing sides of the stack as shown in FIGS. 9, 10, and 13; and ii) are arranged such that the female side of the emboss 60 of a dispenser napkin 10 within the stack is in contact with the female side of the emboss 60 of an adjacent dispenser napkin 10 as shown in FIG. 13.

FIG. 9 shows a side view of a stacked dispenser-napkin embodiment wherein the tab-portion 80 positions on adjacent dispenser napkins 10 alternate between two opposing sides of the stack; and each napkin's male side of the emboss 40 is in contact with the male side of the emboss 40 of an adjacent dispenser napkin 10 within the stack.

FIG. 10 shows a side view of a stacked dispenser-napkin embodiment wherein the tab-portion 80 positions on adjacent dispenser napkins 10 alternate between two opposing sides of the stack; and each napkin's male side of the emboss 40 is in contact with the female side of the emboss 60 of an adjacent dispenser napkin 10 within the stack.

FIG. 11 shows an exploded view of two adjacent dispenser napkins 10 within a stack, wherein one dispenser napkin's female side of its emboss 60 is in contact with an adjacent dispenser napkin's male side of its emboss 40.

FIG. 12 shows a dispenser-napkin embodiment that can be used in the stacked dispenser-napkin embodiments. "L" represents the dispenser napkin's length; "W" represents the dispenser napkins width; the dispenser napkin 10 has four panels respectively identified as panels 1, 2, 3, and 4; and the width of panels 1 and 3 are respectively depicted as 1 and 3.

FIG. 13 shows a side view of a stacked dispenser-napkin embodiment wherein the tab-portion 80 positions on adjacent dispenser napkins 10 alternate between two opposing sides of the stack; and each napkin's female side of the emboss 60 is in contact with the female side of the emboss 60 of adjacent dispenser napkins 10 within the stack.

Stacked-napkin embodiments can have any number of dispenser napkins within the stack. As a non-limiting example, a stacked-napkin embodiment has 500 dispenser napkins within the stack. In another non-limiting example, a stacked-napkin embodiment has 1000 dispenser napkins within the stack.

Stacked-napkin embodiments are stacked according to the interfolded arrangement shown in FIGS. 1 and 2.

Stacked-napkin embodiments have four-panel dispenser napkins with tab portions. A folding method for manufacturing a four-panel napkin with tab portions is well known to someone of ordinary skill in the art and can be determined without exercising undue experimentation. FIGS. 3-7 show folding techniques that can be used to manufacture four-panel dispenser napkins 10 with tab portions 80. In an embodiment, the area of a stacked dispenser napkin's tab portion makes up about 2-5% of the dispenser napkin's total area. In other embodiments, the area of a stacked dispenser napkin's tab portion makes up about 5-10% of the dispenser napkin's total area. In still other embodiments, the area of a stacked dispenser napkin's tab portion makes up about 5-20% of the dispenser napkin's total area. Furthermore, in additional embodiments, a stacked dispenser napkin's tab-portion area makes up about 2-50% of a dispenser napkin's total area.

In at least some dispenser-napkin stack embodiments, and as shown in FIG. 12, each napkin's dispenser-napkin panels 1 and 2 have respective areas that are equal to each other, while at the same time, dispenser-napkin panels 3 and 4 have respective areas that are equal to each other; furthermore as shown in FIG. 12, each of the respective areas of dispenser-napkin panels 1 and 2 are greater than the respective areas of dispenser-napkin panels 3 and 4. In embodiments, the combined areas of panels 1 and 2 is greater than the combined areas of panels 3 and 4 by 2-5%. In embodiments, each of the stacked dispenser napkins have an area of approximately 108 inches. In embodiments, each of the stacked dispenser napkins have a first-side width ranging from approximately 5 inches to 20 inches and a second-side length ranging from approximately 6 inches to 24 inches. In embodiments, each of the stacked dispenser napkins have a first-side width of approximately 8.50 inches and a second-side length of approximately 12.75 inches.

In other dispenser-napkin stack embodiments, the four dispenser-napkin panels respectively have four different areas.

Stacked-napkin embodiments have alternating tab 80 positions within the stack as shown in FIGS. 9, 10, and 13.

Stacked dispenser-napkin embodiments are arranged such that the male side of the emboss 40 of a napkin 10 within the stack is in contact with the female side of the emboss 60 arrangement of adjacent dispenser napkins 10, or vice versa, as shown in FIGS. 10 and 11. In an embodiment, at least two dispenser napkins are arranged in this manner within the stack, and in other embodiments, substantially all of the dispenser napkins are arranged in this manner.

In other embodiments, dispenser-napkin embodiments are arranged such that the male side of the emboss 40 of a napkin 10 within the stack is in contact with the male side of the emboss 40 arrangement of adjacent dispenser napkins 10 as shown in FIG. 9. In an embodiment, at least two dispenser napkins are arranged in this manner within the stack, and in other embodiments, substantially all of the dispenser napkins are arranged in this manner within the stack.

In other embodiments, dispenser-napkin embodiments are arranged such that the female side of the emboss 60 of a napkin 10 within the stack is in contact with the female side of the emboss 60 arrangement of adjacent dispenser napkins 10 as shown in FIG. 13. In an embodiment, at least two dispenser napkins are arranged in this manner within the stack, and in other embodiments, substantially all of the dispenser napkins are arranged in this manner.

Stacked dispenser-napkin embodiments have dispenser napkins that have any known length, width, or area.

Stacked dispenser-napkin embodiments have paper dispenser napkins or dispenser napkins manufactured from any other known material for making dispenser napkins. In embodiments, the stacked dispenser napkins are made with paper having a basis weight of 8.5-30 lb/3000 $ft^2$.

In embodiments, dispenser towels can be stacked in the same manner as any of the stacked dispenser-napkin embodiments taught herein.

All described embodiments can be employed alone or in combination with one or more described embodiments. Persons of ordinary skill in the art can stack the dispenser napkins as described above without having to exercise undue experimentation.

What is claimed is:

1. A stacked dispenser-napkin composition comprising:

a plurality of stacked and interfolded dispenser napkins;

each dispenser napkin being embossed and having a male side of the emboss and a female side of the emboss;

each dispenser napkin having a first, second, third, and fourth panel, the four panels being defined by a first fold and a second fold;

each dispenser napkin's first and second panels being adjacent to each other and having respective areas that are substantially equal;

each dispenser napkin's third and fourth panels being adjacent to each other and having respective areas that are substantially equal;

the combined areas of each dispenser napkin's first and second panels being greater than the combined areas of the dispenser napkin's third and fourth panels;

each dispenser napkin having a tab portion, the tab portion being the portions of the first and second panel areas that are not covered by the third and fourth panel areas when the first and second panels are folded onto the third and fourth panels via the first fold; the plurality of stacked and interfolded dispenser napkins being arranged within the stack such that the positions of the respective tab portions on adjacent dispenser napkins alternate between two opposing sides of the stack; and the plurality of stacked and interfolded dispenser napkins being arranged within the stack such that the position of a stacked dispenser napkin's male side of its emboss is in contact with an adjacent dispenser napkin's female side of its emboss.

2. The composition of claim 1, wherein substantially all of the stacked dispenser napkins each have their respective male side of the emboss in contact with an adjacent dispenser napkin's female side of the emboss.

3. The stacked dispenser-napkin composition of claim 1, wherein for each of the stacked and interfolded dispenser napkins, the combined areas of the first and second panels is greater than the combined areas of the third and fourth panels by 2-5%.

4. The stacked dispenser-napkin composition of claim 1, wherein the tab portion of each of the stacked and interfolded dispenser napkins has an area ranging from 2-50% of its respective dispenser napkin.

5. The composition of claim 1, wherein the plurality of stacked and interfolded dispenser napkins are made with paper having a basis weight of 8.5 to 30 lb/3000 $ft^2$.

6. The stacked-napkin composition of claim 1, wherein for each of the stacked and interfolded dispenser napkins, the combined areas of each napkin's four panels is approximately 108 $inches^2$.

7. The stacked-napkin composition of claim 1, wherein each napkin has a first-side width ranging from 5 inches to 20 inches and a second-side length ranging from 6 inches to 24 inches.

8. The stacked-napkin composition of claim 1, wherein each napkin has a first-side width of approximately 8.50 inches and a second-side length of approximately 12.75 inches.

9. The stacked-napkin composition of claim 1, wherein each dispenser napkin has a tab portion that makes up about 2% of the dispenser napkin's area.

10. The stacked-napkin composition of claim 1, wherein each dispenser napkin has a tab portion that makes up about 2-5% of the dispenser napkin's area.

11. The stacked-napkin composition of claim 1, wherein each dispenser napkin has a tab portion that makes up about 5-10% of the dispenser napkin's area.

12. A stacked dispenser-napkin composition comprising:

a plurality of stacked and interfolded dispenser napkins;

each dispenser napkin being embossed and having a male side of the emboss and a female side of the emboss;

each dispenser napkin having a first, second, third, and fourth panel, the four panels being defined by a first fold and a second fold;

each dispenser napkin's first and second panels being adjacent to each other and having respective areas that are substantially equal;

each dispenser napkin's third and fourth panels being adjacent to each other and having respective areas that are substantially equal;

the combined areas of each dispenser napkin's first and second panels being greater than the combined areas of the dispenser napkin's third and fourth panels; and each dispenser napkin having a tab portion, the tab portion being the portions of the first and second panel areas that are not covered by the third and fourth panel areas when the first and second panels are folded onto the third and fourth panels via the first fold; the plurality of stacked and interfolded dispenser napkins being arranged within the stack such that the positions of the respective tab portions on adjacent dispenser napkins alternate between two opposing sides of the stack.

13. A stacked dispenser-napkin composition comprising:

a plurality of stacked and interfolded dispenser napkins;

each dispenser napkin being embossed and having a male side of the emboss and a female side of the emboss;

each dispenser napkin having a first, second, third, and fourth panel, the four panels being defined by a first fold and a second fold;

each dispenser napkin's first and second panels being adjacent to each other and having respective areas that are substantially equal;

each dispenser napkin's third and fourth panels being adjacent to each other and having respective areas that are substantially equal;

the combined areas of each dispenser napkin's first and second panels being greater than the combined areas of the dispenser napkin's third and fourth panels; and the plurality of stacked and interfolded dispenser napkins being arranged within the stack such that the position of a stacked dispenser napkin's male side of its emboss is in contact with an adjacent dispenser napkin's female side of its emboss.

14. A stacked dispenser-napkin composition comprising:

a plurality of stacked and interfolded dispenser napkins;

each dispenser napkin being embossed and having a male side of the emboss and a female side of the emboss;

each dispenser napkin having a first, second, third, and fourth panel, the four panels being defined by a first fold and a second fold;

each dispenser napkin's first and second panels being adjacent to each other and having respective areas that are substantially equal;

each dispenser napkin's third and fourth panels being adjacent to each other and having respective areas that are substantially equal;

the combined areas of each dispenser napkin's first and second panels being greater than the combined areas of the dispenser napkin's third and fourth panels;

each dispenser napkin having a tab portion, the tab portion being the portions of the first and second panel areas that are not covered by the third and fourth panel areas when the first and second panels are folded onto the third and fourth panels via the first fold; the plurality of stacked and interfolded dispenser napkins being arranged within the stack such that the positions of the respective tab portions on adjacent dispenser napkins alternate between two opposing sides of the stack; and the plurality of stacked and interfolded dispenser napkins being arranged within the stack such that the position of a stacked dispenser napkin's female side of its emboss is in contact with an adjacent dispenser napkin's female side of its emboss.

* * * * *